United States Patent [19]

Stultz

[11] Patent Number: 4,993,561

[45] Date of Patent: Feb. 19, 1991

[54] MERCHANDISING SYSTEM

[75] Inventor: Randall W. Stultz, Phoenix, Ariz.

[73] Assignee: Design Sciences International, Inc., Phoenix, Ariz.

[21] Appl. No.: 290,303

[22] Filed: Dec. 22, 1988

[51] Int. Cl.[5] ..... B42F 00/00

[52] U.S. Cl. ..... 211/55; 211/128; 362/125; 362/133

[58] Field of Search ..... 211/55, 128; 312/126; 40/661, 564, 336; 362/125, 133

[56] References Cited

U.S. PATENT DOCUMENTS

| | | | |
|---|---|---|---|
| 1,765,223 | 6/1930 | Ferris . | |
| 3,333,709 | 8/1967 | Leblanc et al. | 211/13 |
| 3,341,026 | 9/1967 | Spitler | 211/88 |
| 3,357,568 | 12/1967 | Leblanc et al. | 211/13 |
| 3,908,830 | 9/1975 | Skrzelowski | 211/55 |
| 4,099,813 | 7/1978 | Olivan | 211/55 X |
| 4,180,921 | 1/1980 | Elbaum et al. | 35/59 |
| 4,204,602 | 5/1980 | Dunchock | 211/13 |
| 4,541,534 | 9/1985 | Strauss | 211/13 |
| 4,609,975 | 9/1986 | Badolato et al. | 362/125 |
| 4,613,047 | 9/1986 | Bushyhead et al. | 211/55 |
| 4,616,755 | 10/1986 | Adolfsson | 211/89 |

FOREIGN PATENT DOCUMENTS

| | | | |
|---|---|---|---|
| 2323065 | 5/1973 | Fed. Rep. of Germany . | |
| 1480331 | 4/1967 | France | 211/55 |

*Primary Examiner*—Blair M. Johnson

*Attorney, Agent, or Firm*—Cahill, Sutton & Thomas

[57] ABSTRACT

A low cost modular merchandising system includes vacuum-formed feature racks with a rectangular array of front pocket recesses which can be used to support graphic inserts, products displayed for sale, and a wide variety of merchandising accessories including support pedestals, shelves, product/graphics support elements, backlit display elements, and microswitches that respond to removal of a supported article to control lights, burglar alarms, inventory computer, etc.

26 Claims, 6 Drawing Sheets

2
11
6
5
12
12A
4
8
10A
10D
10
7
10
10B
10D
10D
10C
1
3
2
2
15
15E
15A
15B
15D
15C

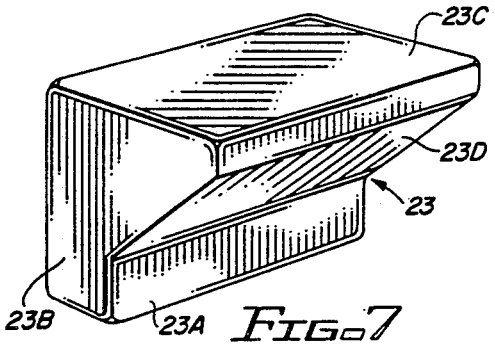
FIG. 7
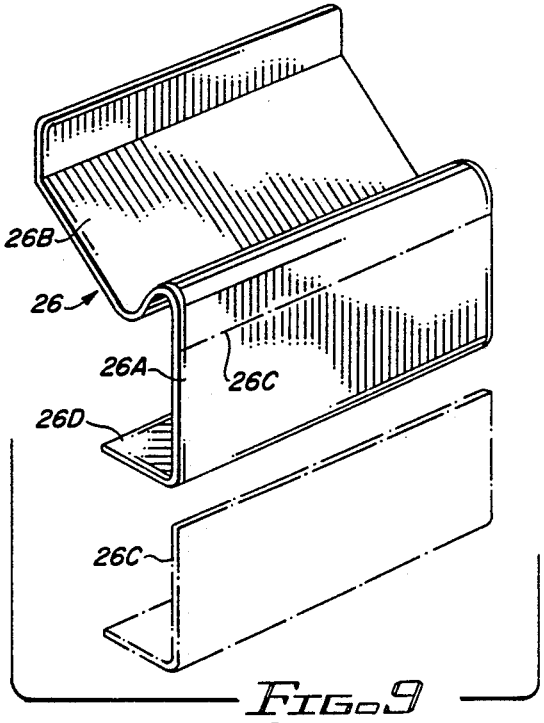
FIG. 8
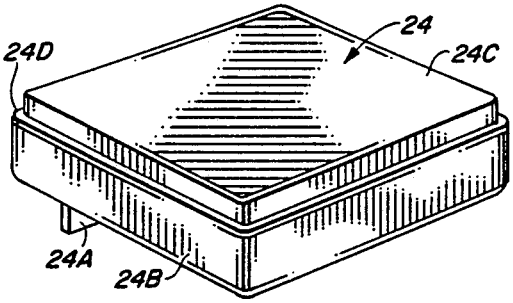
FIG. 9
FIG. 10
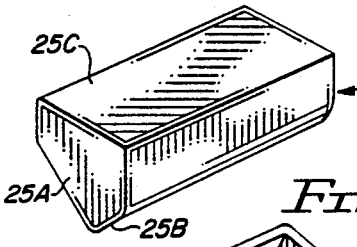
FIG. 11
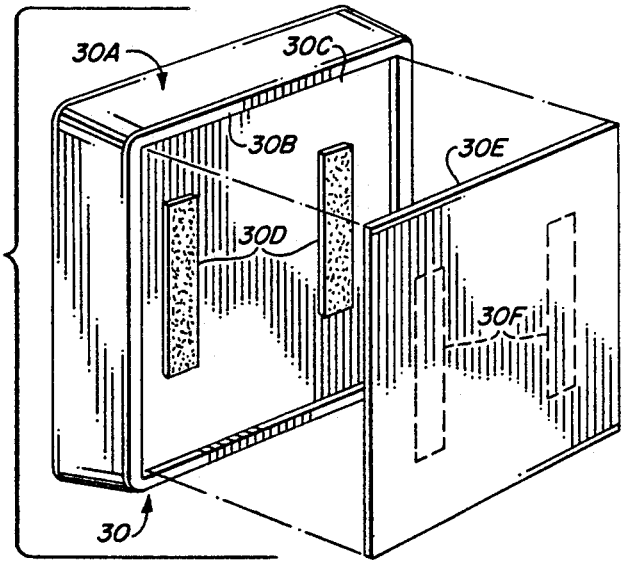
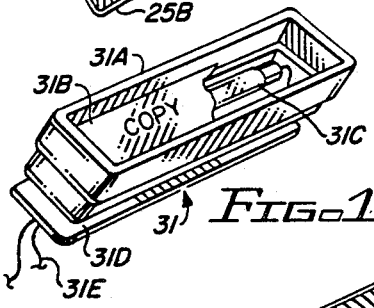
FIG. 12
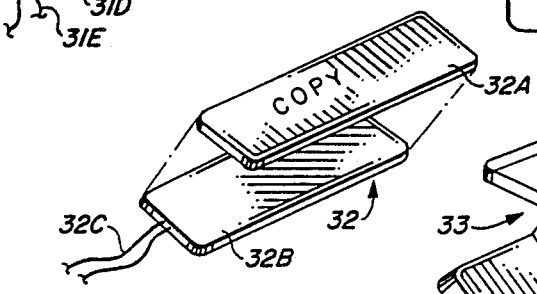
FIG. 13
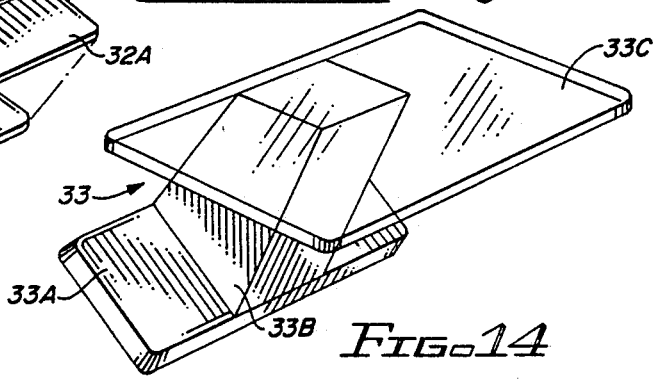
FIG. 14

MERCHANDISING SYSTEM

BACKGROUND OF THE INVENTION

The invention relates to an improved, highly versatile merchandising apparatus for display of merchandise, such as eyeglasses, and more particularly to a versatile feature rack and a variety of display accessories that are easily mounted on the feature rack.

For many years eyeglasses and other merchandise such as jewelry have been displayed in retail establishments by means of a wide variety of racks, including carousel display cases and various non-rotatable display cases and racks. Because eyeglass frames and other jewelry and wearable items have become more and more important as fashion accessories and as functional items, a prospective purchaser encounters more difficulty in selecting from a display of a large number of selectable items one which will best suit his or her taste and physical attributes.

Prior display racks and the like are quite expensive to construct, and are generally very limited in the types of articles and information that can be displayed thereon. Prior display devices are not sufficiently versatile to be able to display a large number of articles and also display helpful promotional information in a convenient, attractive, alluring fashion which is genuinely helpful in assisting prospective purchasers to make a selection that fits their tastes and physical attributes. Prior merchandising/display systems do not have the capability of allowing rapid exchange of both graphic information supports and associated product display supports, pedestals, and the like. The prior devices lack the capability of having their overall appearance and display function easily altered to tastefully accommodate a new product line and/or a new line of associated graphic display material. The prior display systems lack the capability of being integrated tastefully with a variety of building interior designs so as to form an integral part of the interior architecture of a sales room.

SUMMARY OF THE INVENTION

Accordingly, it is an object of the invention to provide a merchandising system which is versatile in accepting a wide variety of display accessories and associated promotional materials oriented to articles supported in various fashions by the display accessories.

It is an object of this invention to provide a versatile, low cost system for display of merchandise and promotional articles.

It is an object of the invention to provide a display system that is easily integrated into the interior architecture of a sales room or the like.

Briefly described, and in accordance with one embodiment thereof, the invention provides a vertical feature rack which includes a plastic, vacuum formed structure attached to a vertical display rack. The feature rack includes a plurality of empty front pockets. Each front pocket has a recess with a forwardly sloping bottom, a pair of side walls, and a front wall which together define a recess. Each pocket recess can receive and support a wide variety of merchandising accessories, some of which can support other accessories, such as advertising material, microswitches, graphic modules, feature pedestals, feature blocks, tri-face articulation, display shelves, and the like.

BRIEF DESCRIPTION OF THE DRAWINGS

FIG. 7 is a perspective view of a feature pedestal which can be supported by the product/graphics support element of FIG. 6.

FIG. 8 is a perspective view of a feature pedestal that can be supported in a pocket recess of the feature rack of FIG. 1.

FIG. 9 is a perspective view of another product/graphics support element.

FIG. 10 a perspective view of a universal mounting pedestal which can be supported by a pocket of the feature rack.

FIG. 11 a exploded perspective view of a base which can be supported by an empty pocket of the feature rack and which supports a graphic insert.

FIG. 12 a perspective view of an illuminated display article for supporting illuminated advertising material.

FIG. 13 is a diagram of a microswitch hidden by a card imprinted with identification information.

FIG. 14 is a perspective view of a feature pedestal.

DETAILED DESCRIPTION OF THE PREFERRED EMBODIMENTS

Figures 1, 3:
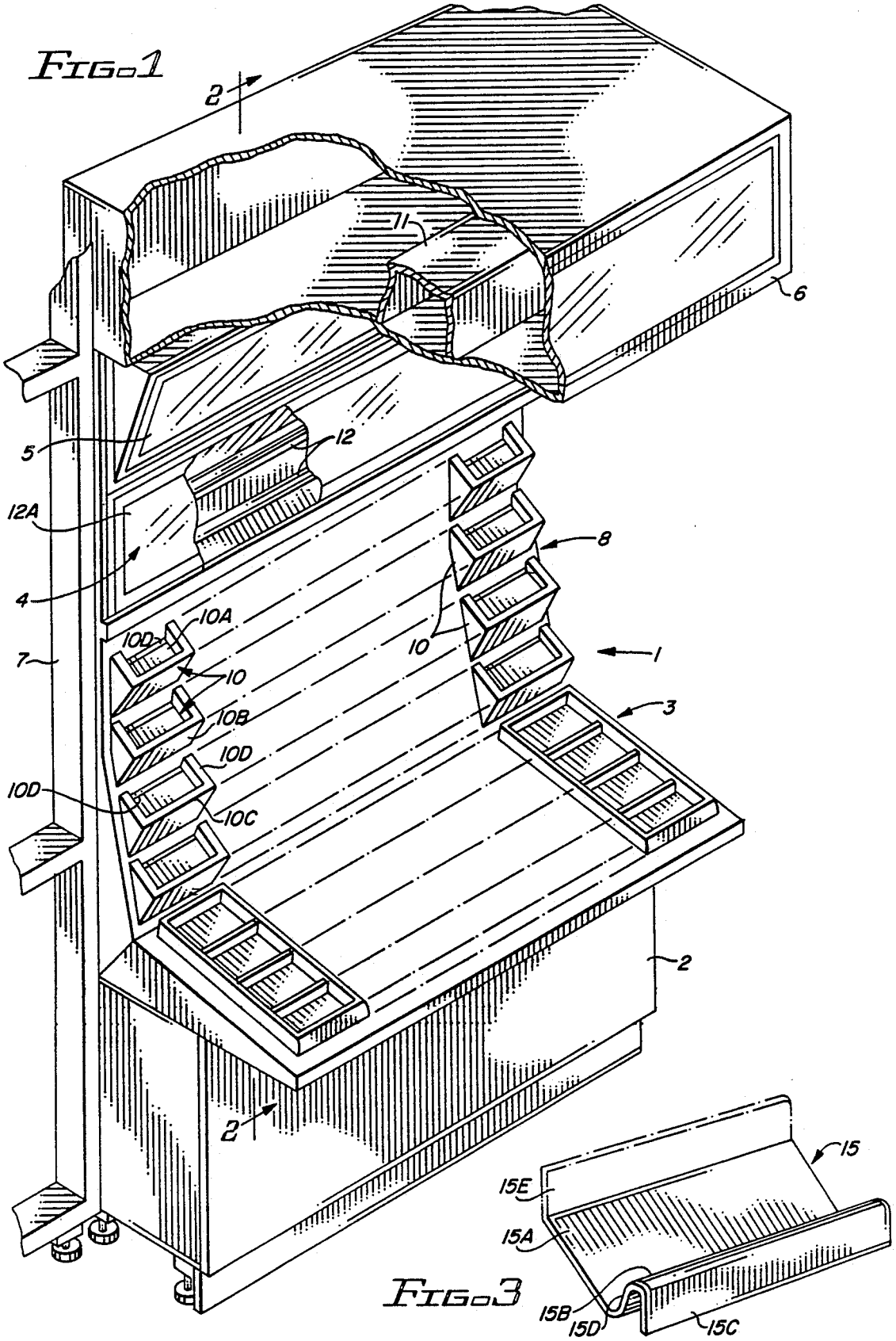
FIG. 1 is a partial cutaway perspective view of the merchandising system of the present invention.
FIG. 3 is a perspective view of a product/graphics support element which can be inserted in an empty front pocket of the feature rack of FIG. 1.
Figures 2, 4, 5, 6:
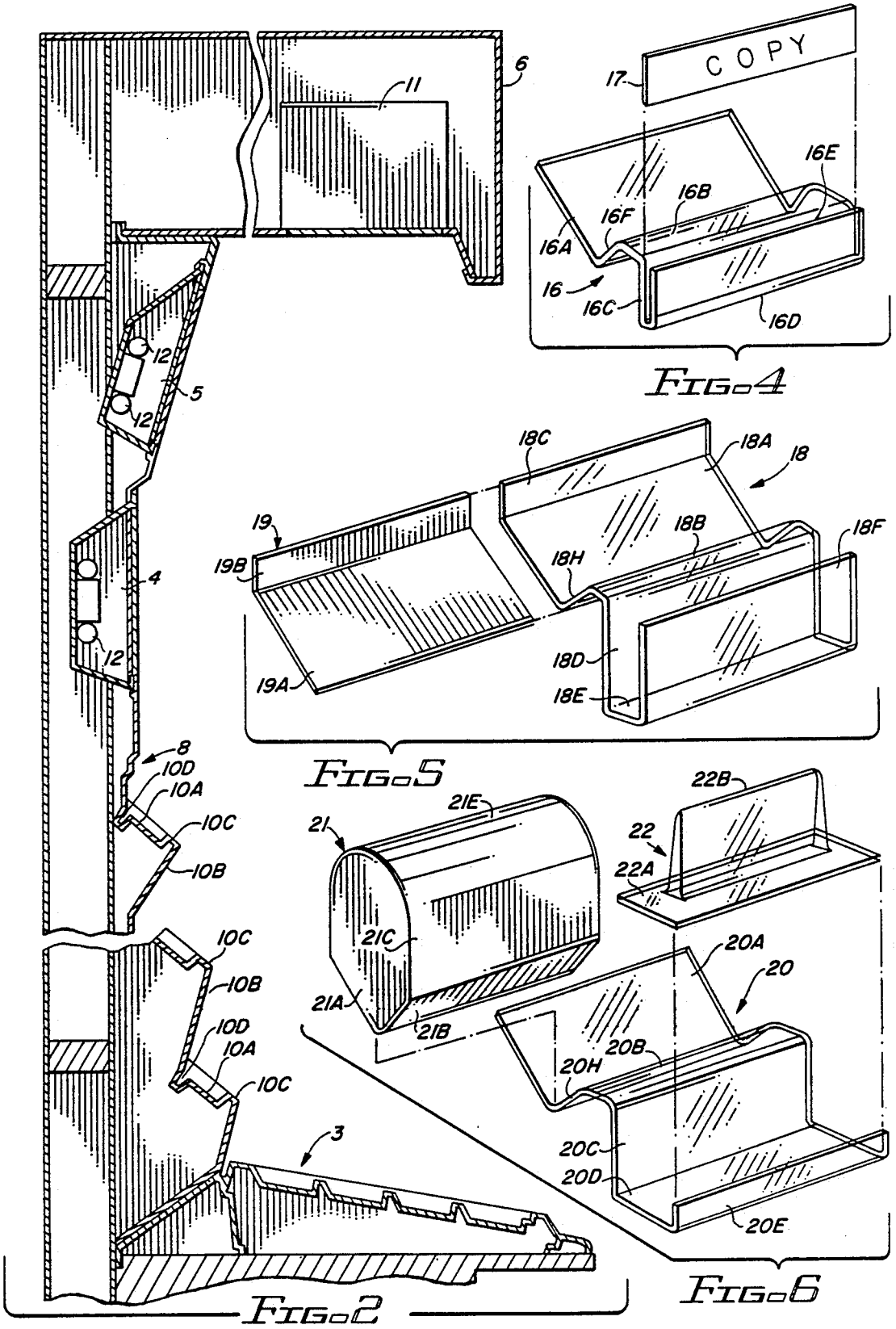
FIG. 2 is a section view along section line 2—2 of FIG. 1.
FIG. 4 is a perspective view of another product/graphics support element.
FIG. 5 is a perspective view of another product/graphics support element.
FIG. 6 is an exploded view of another product/graphics support element and several display articles that can be supported by that product/graphics support element.

Referring to FIGS. 1 and 2, numeral 1 designates a complete display rack embodying the present invention. Display rack 1 includes a base 2 which either rests on a floor surface or is mounted to a vertical wall or strut structure or the like. A lower feature rack 3, which may be vacuum-formed plastic with a plurality of tray compartments therein, it is disposed on a horizontal surface supported by base 2.

Base 2 is formed between two rigid vertical frame struts or members 7 which support upper portions of the display rack 1, including a feature rack 8 which is composed of vacuum-formed plastic. The vertical frame members 7 also support a fluorescent light assembly 4 which has a pair of fluorescent bulbs 12 behind a translucent panel or screen 12A on which multicolor transparencies or the like displaying backlit merchandising information can be disposed. A second backlit graphic assembly 5 is supported by frame members 7 above light assembly 4. Finally, an overhead light unit 6 is supported above light assembly 5.

Figure 16:
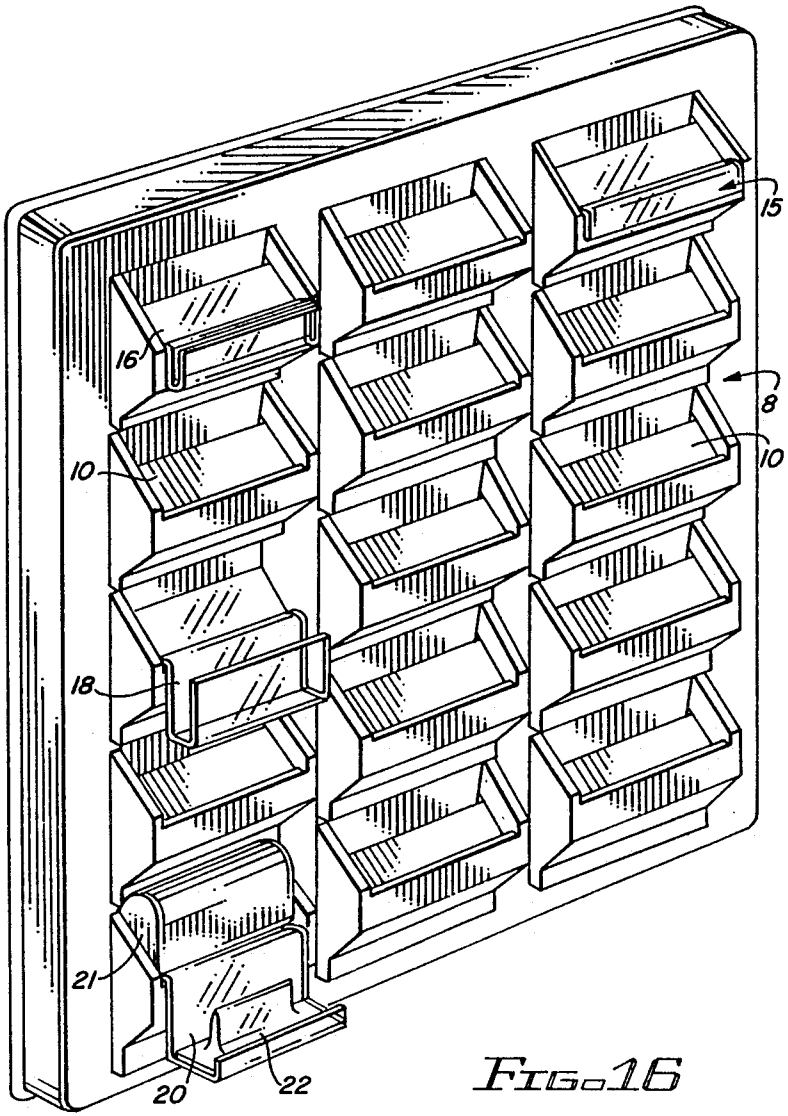
FIG. 16 is a perspective view of a feature rack showing another group of product/graphics support elements in accordance with the invention.
Figure 15:
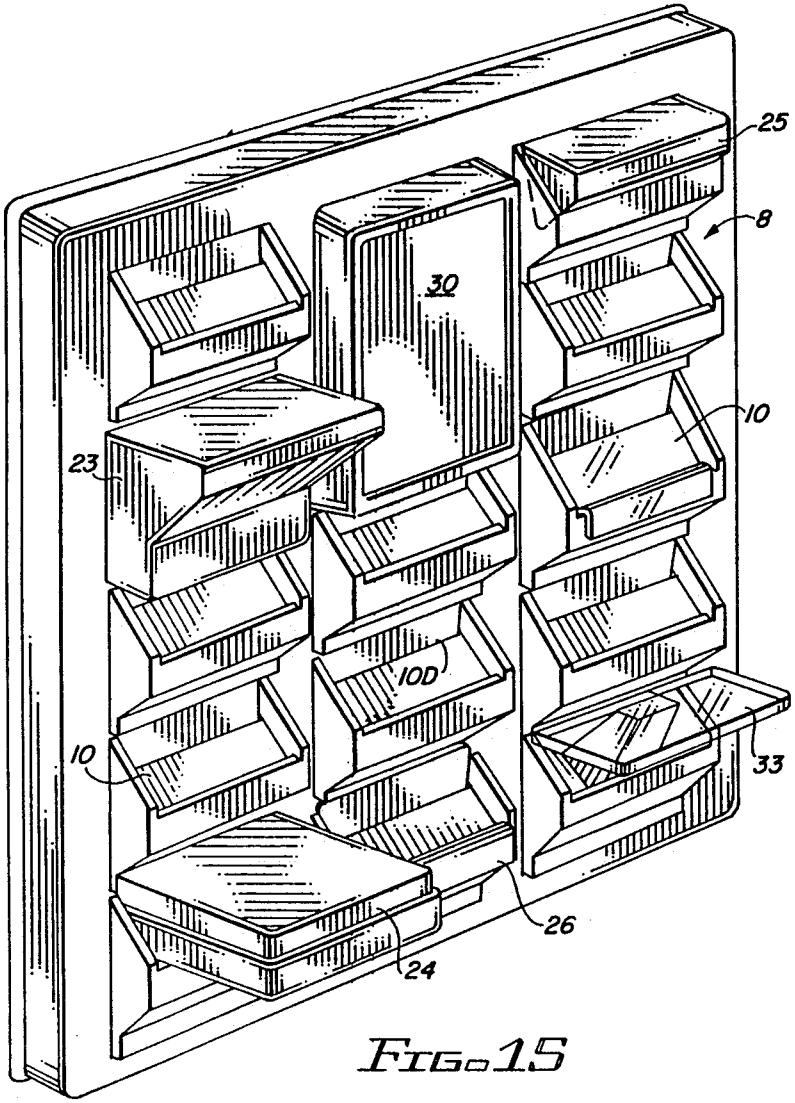
FIG. 15 is a perspective view of a feature rack supporting a variety of the product/graphics support elements and feature pedestals of the invention.

In accordance with the present invention, the vacuum-formed feature rack 8 has a plurality of empty front "pockets" 10 arranged in a rectangular array for supporting a wide variety of merchandising accessories. FIGS. 15 and 16 show an implementation of feature rack 8 in which the pockets 10 support various "product/graphics support elements", shelves, and features racks, as subsequently explained in more detail.

As indicated in FIG. 1, each pocket 10 includes a recess 10A bounded by a front lip 10C and two sides 10B. The depth of each pocket recess 10A typically is one-half inch to one inch. The length and width of each pocket recess 10A typically are three to five inches and six to seven inches, respectively. Each pocket recess has a slot 10D, at its rear edge formed by the bottom of the next higher pocket 10.

Figures 17, 18:
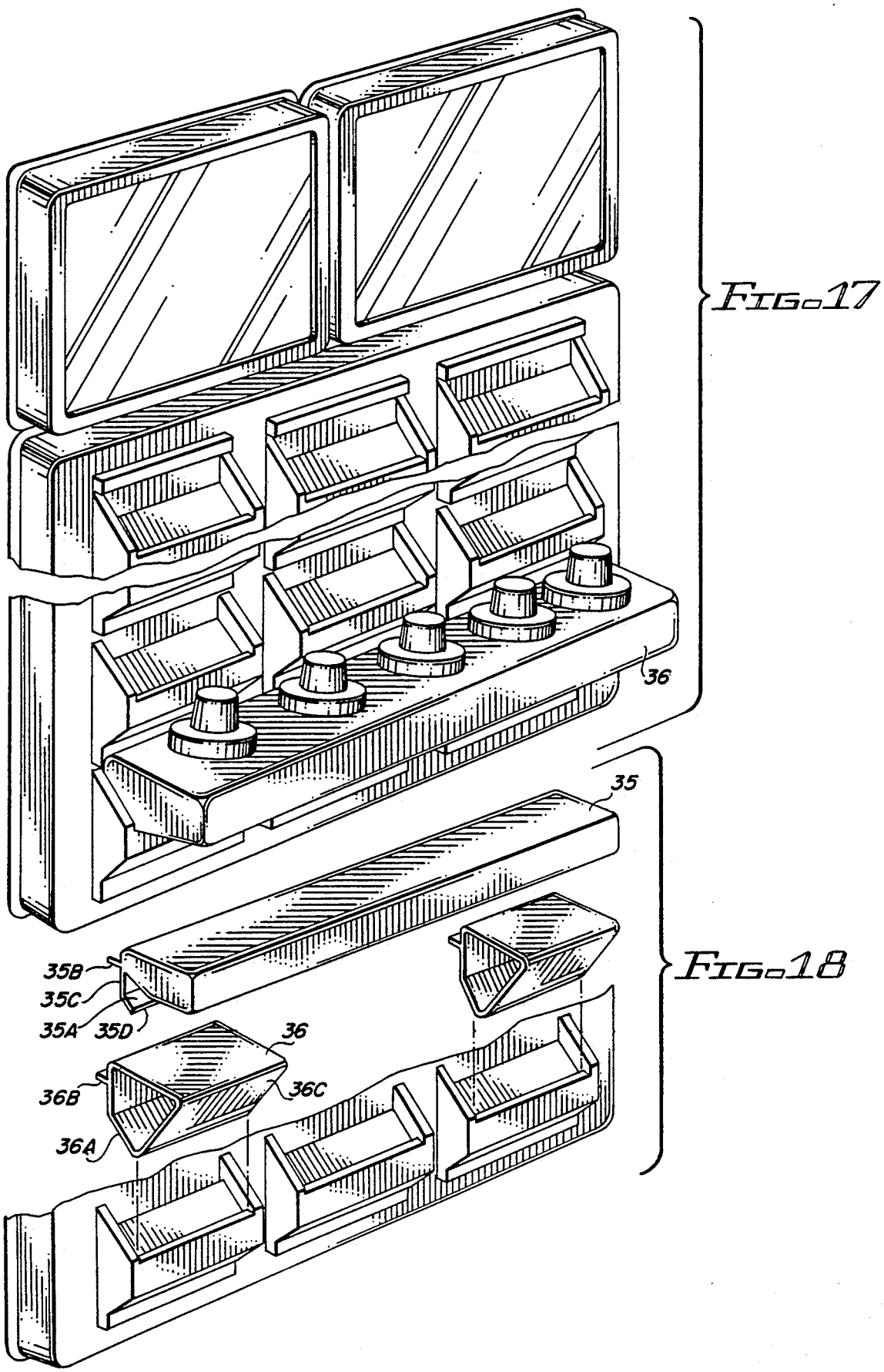
FIG. 17 is a perspective view of a feature rack including a feature pedestal accessory and a pair of transparent display screens.
FIG. 18 is a partial perspective view of a feature rack showing several alternate pedestal accessories.

The recesses 10A of each of the pockets 10 may be utilized to support articles being displayed for sale. For example, a pair of eyeglass frames can be supported and displayed in each pocket recess 10A. The modular design of the feature rack 8 also allows many merchandising accessories to be installed on and supported by the various pocket recesses 10A. In FIG. 15, for example, a shelf unit 23 is supported by one pocket recess. An extending horizontal shelf 24 of different design is supported in a different manner by another pocket recess 10A. Yet a different design of a smaller feature shelf 25 is supported by another pocket recess. A feature pedestal 33 with a horizontal transparent shelf thereon is supported in another pocket recess. A pair of vertically aligned pocket recesses support a display unit 30 with a graphic insert on its vertical front face. In FIG. 16, a variety of different "product/graphics support elements" 15, 16, 18, and 20 are supported by various pocket recesses. In FIG. 17, a group of three horizontally aligned pocket recesses support an elongated shelf having a horizontal upper surface with a number of posts for supporting products displayed for sale. FIG. 18 illustrates a plane shelf 35 which can be supported by a group of three horizontally aligned pocket recesses. FIG. 18 also discloses another type of small shelf 36 that can be easily installed in an individual pocket recess 10A for supporting displayed products or advertising material.

Figure 19:
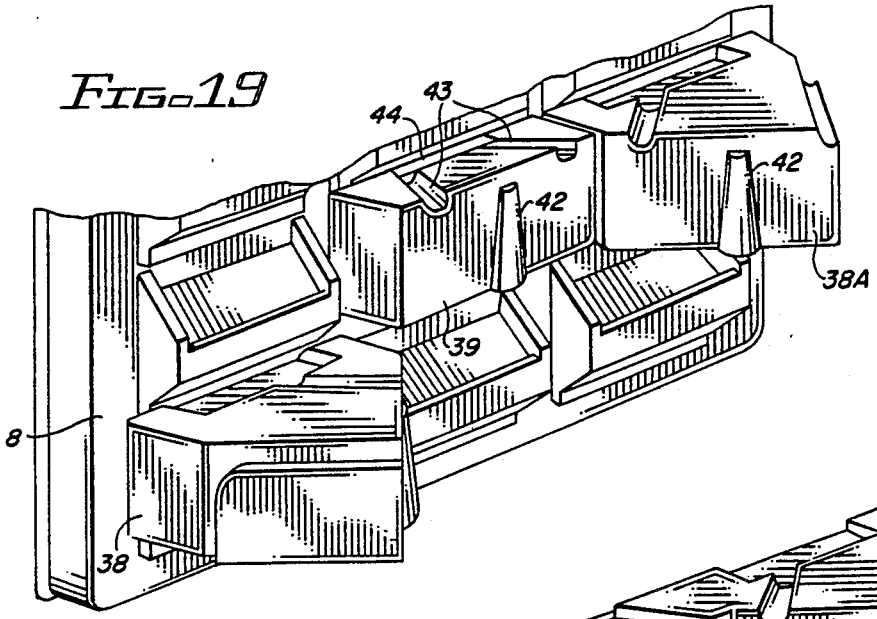
FIG. 19 is a partial perspective view illustrating triangulated feature pedestals.
Figure 20:
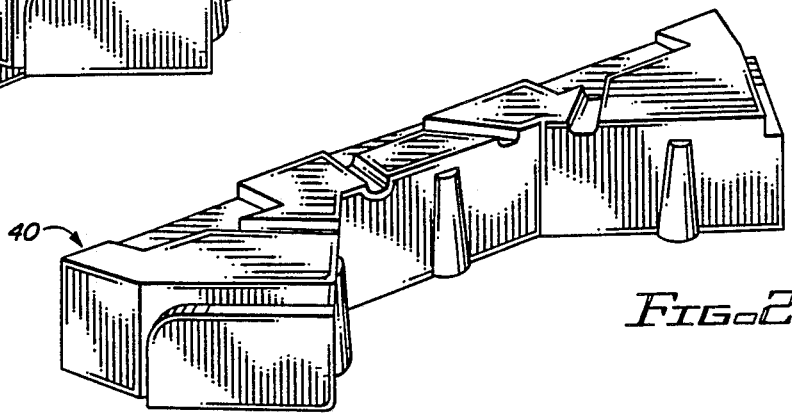
FIG. 20 is a perspective view of a tri-face feature pedestal.
Figure 21:
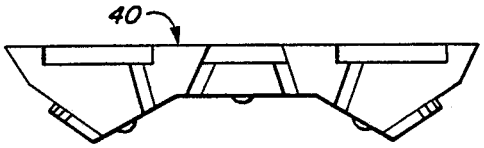
FIG. 21 a top view of the tri-face feature pedestal of FIG. 20.
Figure 22:
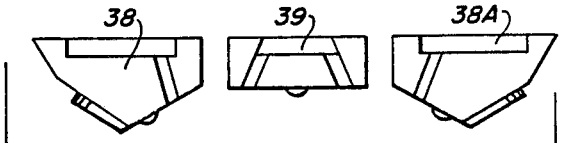
FIG. 22 is a top view illustrating how triangulated feature pedestals can be individually used to provide a tri-face feature rack.

FIG. 19 shows how individually horizontally aligned pocket recesses can support individual right angled, non-angled, and left angled shelves such as 38, 39, and 38A. Or, a group of three horizontally aligned pocket recesses can support a single shelf 40 as shown in FIG. 20 for providing "tri-face articulation".

FIG. 3 shows a simple product/graphics support element 15, which can be formed of extruded plastic, either opaque or transparent. It includes a sloped surface 15A which rests on the bottom sloped surface of a recess pocket 10A. It includes a forward sloped surface 15D that extends upward from surface 15A to form a V-shaped recess. Forward wall 15D extends to a maximum elevation 15B, and provides a curved upper surface that continues downward to form a front panel 15C. If desired, a vertical rear surface 15E, indicated by dashed lines, can extend from the upper edge of sloped surface 15A. Graphic information can be provided on the front vertical surfaces 15C and 15E and on the sloped surface 15A, all of which would be clearly visible to a prospective purchaser. Product/graphics support element 15 is shown installed in a shelf pocket in the upper righthand corner of the feature rack shown in FIG. 16.

In FIG. 4, another product/graphics support element 16 is shown for supporting a product/graphics support element label 17 which typically would have descriptive and/or graphic merchandising information thereon. Product/graphics support element 16 typically would be formed of excluded, clear plastic. It includes a sloped planar section 16A which rests on the sloped bottom surface of a pocket recess 10A. A front sloped surface 15F forms a V-shaped recess with sloped surface 16A. A generally horizontal surface 16B extends over a front lip 10C of a pocket recess 10A (FIG. 1), and a planar vertical section 16C and another planar vertical front section 16D are joined at the bottom to form a slot 16E into which the product/graphics support element label 17 can be easily inserted. A typical product/graphics support element such as 16 is shown installed in a pocket recess in the upper lefthand corner of the feature rack 8 shown in FIG. 16.

FIG. 5 shows another product/graphics support element 18 including sloped surfaces 18A and 18H which form a V-shaped recess, a generally horizontal portion 18B connecting section 18H to a vertical panel 18D, a horizontal bottom panel 18E connecting vertical panel 18D to a front vertical section 18F. A vertical panel 18C is connected to the upper edge of panel 18A. Product/graphics support element 18 can be formed of extruded clear plastic material. A graphic insert card 19 can be placed in product/graphics support element 18, so that section 19A thereof rests on panel 18A of product/graphics support element 18 and panel 19B rests against panel 18C. The wide groove formed between panels 18D, 18E, and 18F can support brochures and the like. Product/graphics support element 18 is shown installed in the middle lefthand pocket recess of feature rack 8 of FIG. 16.

FIG. 6 shows a product/graphics support element 20 including rectangular panels 20A and 20H which form a V-shaped recess that supports product/graphics support element 20 in a pocket recess. Horizontal panel 20B connects panel 20H to a vertical front panel 20C. Panel 20D forms a ledge connected to the bottom edge of vertical panel 20C. The front edge of shelf 20D is connected to an elongated retaining lip 20E. Product/graphics support element 20 can be formed of extruded plastic. Graphic monolith 21 has a semicylindrical upper 21E, a vertical front face 21C on which graphic and textual information can be displayed, and a pair of sloped planar lower surfaces 21A and 21B that rest on the upper surfaces of panels 20A and 20H of product/graphics support element 20. Ledge 20D supports an insert 22 having a flat base 27 and a vertical number 22B which can be used to support a product being displayed. For example, post 22B can be used to support a pair of folded eyeglass frames by extending upward between the lens frames and the folded arms of the pair of eyeglass frames. Product/graphics support element 20 with graphic monolith 21 and insert 22 are shown installed in a pocket recess in the lower lefthand corner of feature rack 8 in FIG. 16. Note that the support elements shown in FIGS. 3, 4, 5 and 6 can be formed from the same extrusions,.

FIG. 7 shows a vacuum-formed feature pedestal 23 having an extending horizontal upper surface 23C, and a rearwardly sloped panel 23D extending downward to an elongated lower front panel 23A, the opposite ends being closed by panels such as 23B. The rear side (not shown) of feature pedestal 23 is open, and inside of it there is a mounting clip which can have an appearance similar to the universal mounting element 25 shown in FIG. 10, with a sloped rear panel 25A forming a V with a sloped front panel 25B that rests in a pocket recess 10A. Feature pedestal 23 is shown installed on a pocket recess in the feature rack 8 of FIG. 15.

FIG. 8 shows another feature pedestal structure 24 having a base 24B in which a pedestal insert 24C with a suitable simulated finish is placed. A tab 24A extends into the bottom of the V-shaped groove formed by the bottom and front wall of a pocket recess. A rear edge shoulder of the base 24B slips underneath the slot 100 that exists along the rear portion of each pocket recess. The feature pedestal 24 is shown installed in a recess pocket in FIG. 15.

FIG. 9 illustrates another product/graphics support element 26 which is similar to product/graphics support element 15 shown in FIG. 3, except that it includes an enlarged front panel 26A on which additional graphic and descriptive matter may be imprinted. Dashed line 26C shows that the lower section can be broken away if desired to form the product/graphics support element 15 of FIG. 3. The lower ledge 26D performs the function of enlarging the available surface area for graphic media presentation and engages a rib such as 10D in FIG. 2 to provide stability.

The above mentioned universal mounting block 25 shown in FIG. 10 can be used as a small feature pedestal, as indicated in the upper righthand feature recess of feature rack 8 in FIG. 15.

FIG. 11 shows an accessory 30 having a vacuum-formed base 30A with a front face 30C that is slightly recessed from the front peripheral edge 30B for receiving a graphic insert panel 30E. Graphic insert panel 30E has display graphics and text imprinted on the front surface thereof. A pair of velcro fasteners 30D on the recess surface 30C mate with velcro fasteners 30F on the backside of graphic insert panel 30E. The back face of vacuum-formed base 30A is open, and contains two mounting blocks or clips such as 25 in FIG. 10 by means of which the display device 30 can be supported by two vertically aligned pocket recesses, as shown in the middle column of pocket recesses in the feature rack 8 of FIG. 15.

FIG. 12 illustrates a backlit product/graphics support element 31 which includes a base 31D from which a pair of electrical conductors 31E extend through a suitable hole in the bottom of a pocket recess 10A to a suitable control switch and power source. A frame 31A includes a lamp assembly 31C and supports a translucent front panel 31B on which suitable graphic and display information is imprinted. A suitable control device turns the lamp on and off, in response to a suitable switch. The base 31D rests on a sloped rear surface of a pocket recess 10A.

FIG. 13 discloses a product/graphics support element including a base 32D containing a microswitch connected to electrical conductors 32C, which are connected to a suitable control device, computer, burglar alarm or the like. A card 32A rests on the upper surface of the microswitch module 32B. Typically, an article displayed for sale might rest on the upper surface of the card 32A. When the article is lifted from the upper surface of card 32A, the removal of its weight actuates the microswitch 32B, which then sends signals to a suitable controller to turn on the display, such as the backlit product/graphics support element 31 of FIG. 12, or actuate a burglar alarm, or indicate to an inventory control computer that a article lifted has been sold if it is not replaced within a certain preselected amount of time.

FIG. 14 illustrates another feature pedestal having a base plate 33A that rests on the sloped back surface of a typical pocket recess 10A. A post 33B extends upward from the upper surface of base plate 33A and has an upper surface to which a transparent horizontal rectangular support plate 33C is attached. Feature pedestal 33 is shown installed in a pocket recess in the lower righthand corner of feature rack 8 of FIG. 15.

In FIG. 17, the shelf 36 is supported in three horizontally aligned pocket recesses in the same fashion as the shelf 35 in FIG. 18. In FIG. 18, three rear tabs such as 35B on the rear surface of shelf 35 extend under one of the above-mentioned ridges. A vertical tab 35C extends downward from the rear edge of shelf 35. A sloped panel 35A is attached to the lower edge of vertical tab 35C, and rests on the sloped bottom surface of a pocket recess. A forward edge 35D of sloped panel 35A abuts the upward sloping wall of the front lip of the pocket recess.

In FIG. 18, a tab 36B similar to tab 35B extends under one of the ridges bounding a pocket recess. Sloped surface 36A and sloped surface 36C form a V which retains the shelf 36 in a pocket recess.

In FIGS. 19–23, the shelves shown are particularly adapted for supporting eyeglass frames. The members 42 support the bridge of a pair of eyeglass frames. The grooves 43 guide the earpieces back toward a deep recess 44 in which the extreme ends of the folding arm of the frames extend.

Figure 23:
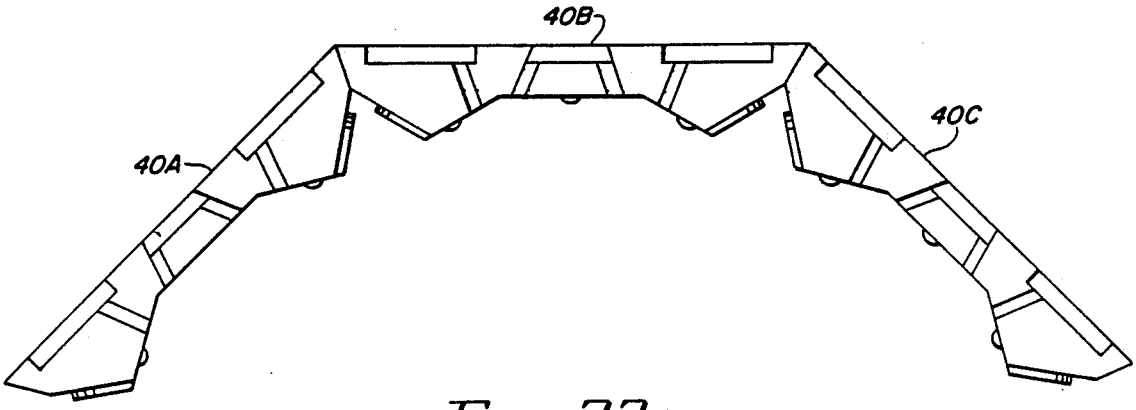
FIG. 23 a top view illustrating an arrangement of feature racks and tri-face articulation feature pedestals.

FIG. 23 illustrates how three of the tri-face articulated shelves 40 could be supported on three separate feature racks to provide a display in which a prospective customer could see a wide variety of pairs of eyeglass frames from one viewing location.

The above described merchandising system provides a highly versatile, modular, merchandising aid which can be adapted to display a wide variety of products and associated merchandising information, allowing the prospective customer a previously unachieved range of choice of articles on sale and variety of illuminated graphic display information. This provides to the prospective buyer all of the information he or she needs to make a good choice. The modularity of the above-described system allows the merchant to easily reconfigure his display system to suit his varying needs, at very low cost.

While the invention has been described with reference to various particular embodiments thereof, those skilled in the art will be able to make various modifications to the described embodiments of the invention without departing from the true spirit and scope of the invention.

What is claimed is:

1. A feature rack comprising in combination:
(a) a vertical panel having a vertical front surface;
(b) an array of pockets disposed on the front surface, each pocket including a pocket recess formed by a bottom surface, first and second sides, and a front lip;
(c) a plurality of display accessory support elements each extending above the front lip of a respective one of the pocket recesses and each supported by a respective one of the various pocket recesses, wherein each of the bottom surfaces is inclined downward from a rear edge to a front edge, and wherein each of the display accessory support elements has an inclined bottom surface that rests on the bottom surface of a corresponding pocket and abuts a front edge of that pocket.

2. The feature rack of claim 1 including a base supporting a slightly inclined display tray and means for mounting the feature rack above the display tray and mounting illuminating display means above the feature rack.

3. A feature rack comprising in combination:
(a) a vertical panel having a vertical front surface;
(b) an array of pockets disposed on the front surface, each pocket including a pocket recess formed by a bottom surface, first and second sides, and a front lip;
(c) a plurality of display accessories supported by various pocket recesses, respectively, wherein one of the display accessories is a product/graphic support element that includes a flat first panel that rests on and is inclined at the same angle as the bottom surface of a first pocket recess, a vertical second panel in front of the first pocket recess, and a contoured web connected to a front edge of the flat first panel and a top edge of the vertical second panel, the web abutting the front lip to retain the product/graphics support element in the pocket recess.

4. The feature rack of claim 3 wherein each of the bottom surfaces is inclined downward from a rear edge to a front edge.

5. The feature rack of claim 3 wherein an angle of inclination of the bottom surface is approximately 45 degrees from the front surface of the vertical panel.

6. The feature rack of claim 1 wherein the vertical second panel has graphic information thereon.

7. The feature rack of claim 3 wherein the product/graphics support element includes a vertical third panel having a lower edge attached to a rear edge of the first panel.

8. The feature rack of claim 1 wherein the product/graphics support element includes a vertical third panel attached at a lower edge by a web to a lower edge of the vertical second panel and defining a slot between the vertical second and third panels.

9. The feature rack of claim 8 wherein the slot is approximately one sixteenth of an inch wide and carries a card with graphic media, and the vertical third panel is transparent.

10. The feature rack of claim 8 wherein the slot is approximately one inch wide and carries a plurality of brochures.

11. The feature rack of claim 3 wherein the product/graphics support element includes a horizontal third panel for supporting a product or graphics element, the horizontal third panel having a rear edge attached to a bottom edge of the vertical second panel and a retaining lip attached to and extending up from a front edge of the horizontal third panel.

12. The feature rack of claim 3 including a horizontal third panel having a front edge attached to a bottom edge of the vertical second panel and a rear edge abutting the vertical surface of the feature rack to stabilize the product/graphics support element.

13. The feature rack of claim 12 wherein another display accessory is a graphic monolith having a bottom surface that conforms to the shape of the first panel and the web connecting the first panel to the vertical second panel.

14. The feature rack of claim 13 wherein yet another display accessory includes a support insert including a base plate which rests on the horizontal third panel and a base extending up from the base plate to support a product on display.

15. A feature rack comprising in combination:
(a) a vertical panel having a vertical front surface;
(b) an array of pockets disposed on the front surface, each pocket including a pocket recess formed by a bottom surface, first and second sides, and a front lip;
(c) a plurality of display accessories supported by various pocket recesses, respectively, wherein each of the bottom surfaces is inclined downward from a rear edge to a front edge, wherein a display accessory includes a shelf, the shelf having a horizontal shelf surface and support means engaging one of the recess pockets for supporting the shelf.

16. The feature rack of claim 15 wherein the recess pocket includes a slot in a rear portion thereof, and the support means includes a tab extending into the slot to retain the shelf.

17. The feature rack of claim 15 wherein the support means includes a member having a lower surface that conforms to the shape of the inclined bottom surface and the front lip.

18. The feature rack of claim 16 wherein the shelf extends substantially forward from the recess pocket.

19. The feature rack of claim 15 wherein the shelf includes a horizontal plate supported by a pedestal which is supported by an inclined base plate resting on the inclined bottom surface.

20. A feature rack comprising in combination:
(a) a vertical panel having a vertical front surface;
(b) an array of pockets disposed on the front surface, each pocket including a pocket recess formed by a bottom surface, first and second sides, and a front lip;
(c) a plurality of display accessories supported by various pocket recesses, respectively, wherein each of the bottom surfaces is inclined downward from a rear edge to a front edge, wherein one of the display accessories includes a lamp enclosed in a housing with a bottom surface resting on the inclined bottom surface and wires extending from a power source through a small hole in the recess pocket to the lamp.

21. A feature rack comprising in combination:
(a) a vertical panel having a vertical front surface;
(b) an array of pockets disposed on the front surface, each pocket including a pocket recess formed by a bottom surface, first and second sides, and a front lip;
(c) a plurality of display accessories supported by various pocket recesses, respectively, wherein each of the bottom surfaces is inclined downward from a rear edge to a front edge, wherein one of the display accessories includes a microswitch and a thin flexible housing encapsulating the microswitch, and wires from the microswitch extending through a hole in a pocket recess to an electrical device controlled by the microswitch, whereby placing a product on display in the pocket recess on the flexible housing actuates the microswitch and controls the electrical device.

22. A feature rack comprising in combination:

(a) a vertical panel having a vertical front surface;

(b) an array of pockets disposed on the front surface, each pocket including a pocket recess formed by a bottom surface, first and second sides, and a front lip;

(c) a plurality of display accessories supported by various pocket recesses, respectively, wherein each of the bottom surfaces is inclined downward from a rear edge to a front edge, wherein one of the display accessories includes a display unit with a vertical face, the display unit having a housing supporting the vertical face and a support means extending over the front lip for engaging at least one pocket recess to support the display unit, the support means including a flat surface that rests on and is inclined at the same angle as the bottom surface of a pocket recess.

23. The feature rack of claim 22 wherein the vertical face is detachable from the housing of the display unit.

24. A feature rack comprising in combination:

(a) a vertical panel having a vertical front surface;

(b) an array of pockets disposed on the front surface, each pocket including a pocket recess formed by a bottom surface, first and second sides, and a front lip;

(c) a plurality of display accessories supported by various pocket recesses, respectively, wherein each of the bottom surfaces is inclined downward from a rear edge to a front edge, wherein one of the display accessories includes a horizontal shelf that extends across the array and includes a plurality of supporting means resting in a plurality of horizontally aligned recess pockets.

25. The feature rack of claim 24 wherein the horizontal shelf includes first and second vertical front edge surfaces that are inclined to the vertical front surface of the feature rack and a third vertical front edge surface that is parallel to the vertical front surface of the feature rack and is positioned between the first and second vertical front edge surface to form a tri-face shelf front.

26. A feature rack comprising in combination:

(a) a vertical panel having a vertical front surface;

(b) an array of pockets disposed on the front surface, each pocket including a pocket recess formed by a bottom surface, first and second sides, and a front lip;

(c) a plurality of product support elements each extending above the front lip of a respective one of the pocket recesses and each supported by a respective one of the various pocket recesses, wherein each of the bottom surfaces is inclined downward from a rear edge to a front edge, and wherein each of the product support elements has an inclined bottom surface that rests on the bottom surface of a corresponding pocket and abuts a front edge of that pocket.

* * * * *